US011631558B2

(12) United States Patent
Petix

(10) Patent No.: US 11,631,558 B2
(45) Date of Patent: Apr. 18, 2023

(54) CONTAINER INCLUDING ILLUMINATOR WITH ZIPPER-ACTUATED SWITCH HAVING MAGNETIC LATCH

(71) Applicant: Giuseppe Petix, Astoria, NY (US)

(72) Inventor: Giuseppe Petix, Astoria, NY (US)

( * ) Notice: Subject to any disclaimer, the term of this patent is extended or adjusted under 35 U.S.C. 154(b) by 98 days.

(21) Appl. No.: 17/305,430

(22) Filed: Jul. 7, 2021

(65) Prior Publication Data

US 2023/0010379 A1 Jan. 12, 2023

(51) Int. Cl.

| | |
|---|---|
| ***H01H 1/54*** | (2006.01) |
| ***A45C 15/06*** | (2006.01) |
| ***H01H 23/16*** | (2006.01) |
| ***H01H 23/04*** | (2006.01) |
| ***F21V 23/04*** | (2006.01) |
| *F21Y 115/10* | (2016.01) |

(52) U.S. Cl.

CPC ..... *H01H 23/16* (2013.01); *F21V 23/0414* (2013.01); *H01H 23/04* (2013.01); *A45C 15/06* (2013.01); *F21Y 2115/10* (2016.08)

(58) Field of Classification Search

CPC . A45C 15/06; H01H 1/54; H01H 5/02; H01H 2001/0042; H01H 2003/506; H01H 2036/0086; H01H 2221/04; H01H 9/44; H01H 9/443; H01H 2001/545

USPC ..... 362/155, 156; 335/170, 195, 205–207

See application file for complete search history.

(56) References Cited

U.S. PATENT DOCUMENTS

| | | | | |
|---|---|---|---|---|
| 2,951,135 | A * | 8/1960 | Ovshinsky | H01H 1/065 335/207 |
| 3,025,372 | A * | 3/1962 | Benjetsky | H01H 36/0073 335/207 |
| 3,056,000 | A * | 9/1962 | Lucas | H01H 9/443 335/207 |
| 3,239,658 | A * | 3/1966 | Castaldo | A45C 15/06 362/458 |
| 3,693,123 | A * | 9/1972 | Pedersen | H01H 13/70 335/206 |
| 4,296,394 | A * | 10/1981 | Ragheb | H01H 5/02 335/206 |
| 7,111,959 | B2 * | 9/2006 | Kurcz | A45C 15/06 362/156 |
| 10,109,432 | B1 * | 10/2018 | Zhao | H01H 21/50 |
| 2005/0174758 | A1 * | 8/2005 | Fields | A45C 15/06 362/156 |
| 2005/0270764 | A1 * | 12/2005 | Kurcz | A45C 15/06 362/34 |
| 2006/0227538 | A1 * | 10/2006 | Williams | A45C 15/06 362/156 |
| 2007/0008714 | A1 * | 1/2007 | Kilfedder | A45C 15/06 362/103 |

(Continued)

*Primary Examiner* — Ismael Negron

(57) ABSTRACT

A switch includes magnet for biasing a contact arm into a close position, the contact arm forced into an open position when an actuating force is applied to an extending portion of the arm. The switch can be operatively coupled to a zipper system of a container such that a zipper slider, when moved to a closed position of the zipper system, contact the extending portion of the arm to provide the actuating force. A circuit is formed by electrically connecting the switch to a battery and light source. The light source illuminates the interior of the container when the zipper slider is moved from a closed zipper system position.

20 Claims, 9 Drawing Sheets

(56) References Cited

U.S. PATENT DOCUMENTS

| | | | | |
|---|---|---|---|---|
| 2012/0042996 | A1* | 2/2012 | Glynn | A45C 15/06 362/100 |
| 2015/0070880 | A1* | 3/2015 | Giunti | A45C 15/06 362/155 |
| 2015/0287561 | A1* | 10/2015 | Levesque | H01F 7/0273 335/205 |
| 2016/0345702 | A1* | 12/2016 | Zamora | A45C 15/06 |
| 2018/0330581 | A1* | 11/2018 | Latief | A45C 15/06 |

* cited by examiner

Firure 3

CONTAINER INCLUDING ILLUMINATOR WITH ZIPPER-ACTUATED SWITCH HAVING MAGNETIC LATCH

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

In most of cases the classic containers are very deep and find something inside them is not easy, especially at the night when the light is low.

Trying to find something inside a container can also be problematic, because sharp and dangerous objects can be contained inside, like for example you can cut yourself with sheets of paper or get hurt with Snap-On objects or get dirty with something that opens inside without your will.

The opening and closing of the containers are usually based on the connection and disconnection of two parts of them and a traditional zipper system is widely used.

The use of a traditional zipper system is in large hand-related for opening and closing some manufactured that contains objects, like for example handheld bags, suitcases, carry-on luggage, backpacks, storage boxes, storage closets, and other various box containers.

Illuminating the interior of traditional handheld bags, suitcases, carry-on luggage, backpacks, storage boxes, storage closets, or others kind of containers, immediately when they are opening, makes easier to find something inside of them, even in the dark.

Innovations in lighting technology have made light sources smaller in physical size more powerful and less cumbersome to install.

Advances in LED technology provide increase in lumen production without producing heat.

These innovations make installing LED lighting on the insides of containers or on the lining of bags and luggage safer, easier, and inexpensive than ever.

Given the compactness of the LED lights, the space occupied in the container is small and the capacity of the container is not compromised.

BRIEF SUMMARY OF THE INVENTION

The present invention refers in general to the field of electromechanical-magnetic circuits and more specifically to a system called "MM System" containing a new type of switch called "Rocking Switch" (1) capable of connecting its ON or OFF mode to a mechanical force acting on a part of it called "extension", for example but not limited to it, to the force acting on a traditional zipper to open and close it.

The essential elements of this device are a battery source (3), a light source (2) and a Rocking Switch (1) having a swinging door (8) with an extension (10).

The Rocking switch (1) is connected to the battery source (3) and to the light source (2) that are in turn connected between them (FIG. 1).

In the embodiment in a container equipped with a traditional zipper, the extension (10) will be placed in such a way that by closing the zipper (21) the extension (10) will be moved and the Rocking Switch (1) will be opened, vice versa by opening the zipper (21) the extension (10) will come back in the rest position and the Rocking Switch (1) will be closed (FIG. 6).

The main purpose of the invention is to use a mechanical force to open a new kind of Normally Closed (NC) switch called "Rocking Switch".

Another main purpose of the invention is that it can be used to create a bright and effective light source to illuminate from the inside all containers that are equipped with a traditional zipper system from the moment they are opening (FIGS. 7/8/9).

Another object of the invention is that the invention can be easily installed inside any container that uses a traditional zipper system.

Another object of the invention is that the Rocking Switch has very low production costs due to its simple parts and it can be produced in different shapes and sizes, even very small ones.

Another object of the invention is that it can have different embodiments, according to the needs of the host container, always respecting the operating forces of the system and the characteristics of its elements, re-proportioning them according to the different needs.

Another object of the invention is that it can be easily repaired by replacing all or a single part with negligible costs.

BRIEF DESCRIPTION OF SEVERAL VIEWS OF THE DRAWINGS

The drawings are part of the present description and include examples of embodiments of the invention which can be realized in several different forms.

In some cases, various aspects of the invention may be shown exaggerated or enlarged to facilitate understanding of the invention.

DETAILED DESCRIPTION OF THE INVENTION

The called "MM System" is an electromechanical-magnetic circuit that uses a magnetic force to close and uses a mechanical force to open.

Figure 1:
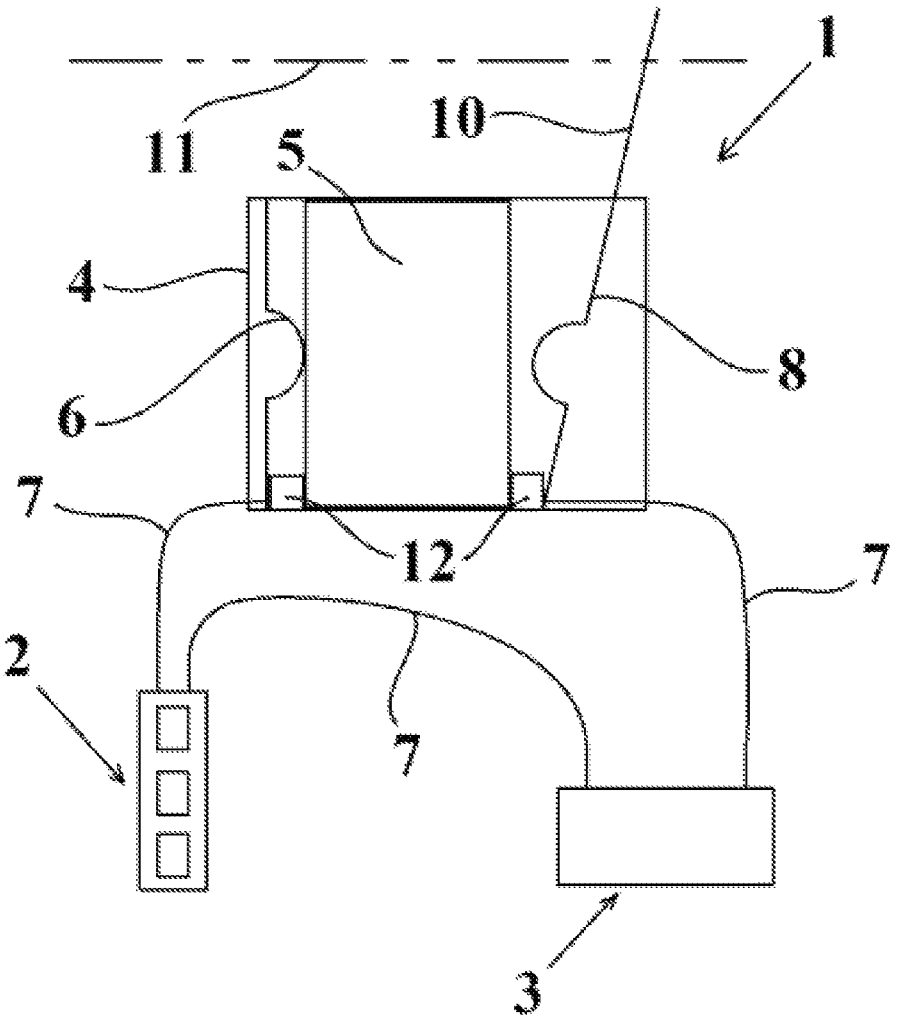
FIG. 1 is a schematic illustration of the components of the "MM System".
Figure 2:
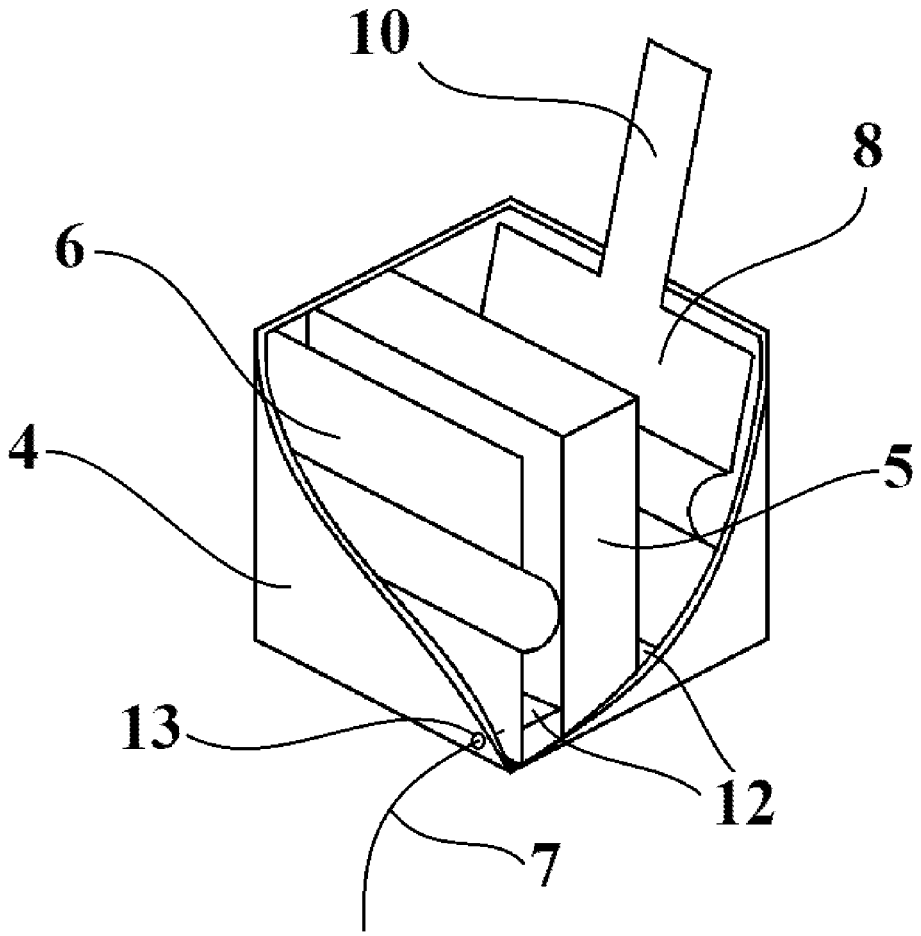
FIG. 2 is a partially transparent perspective view of the "Rocking switch".
Figure 3:
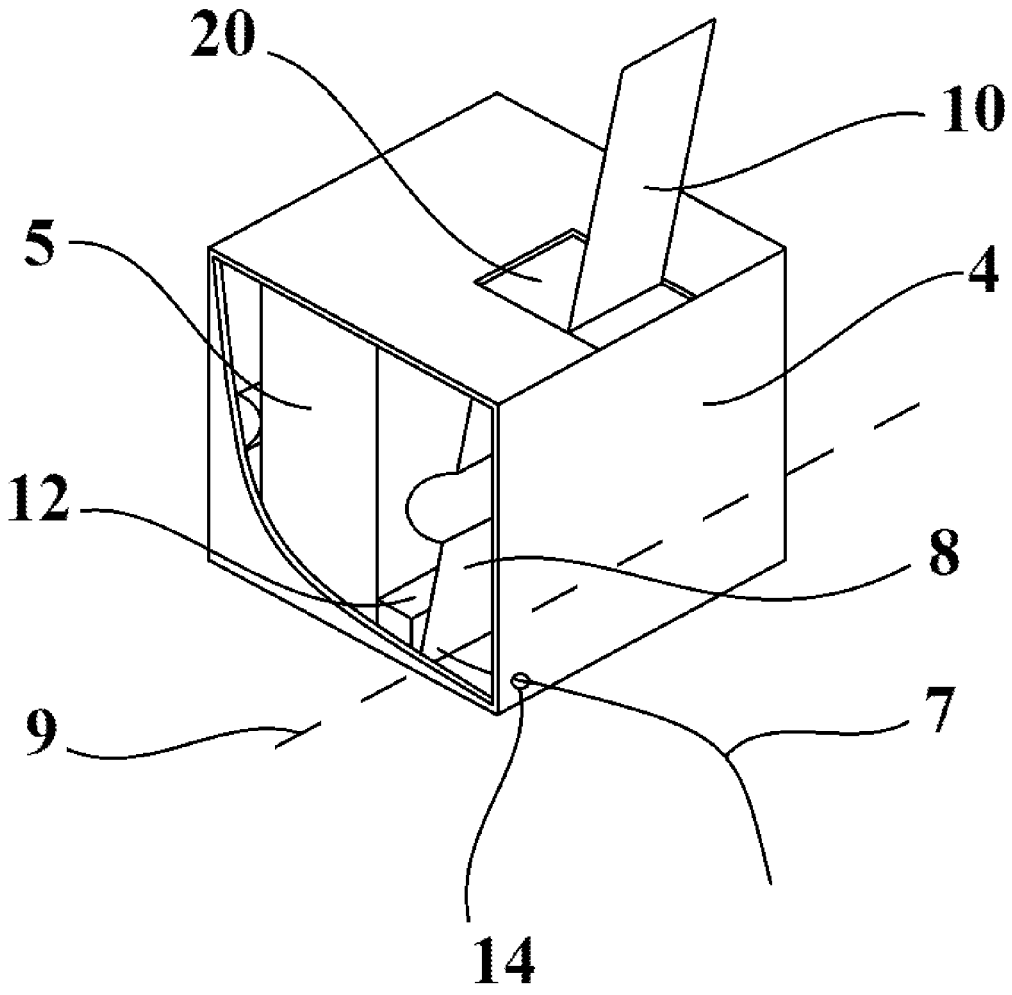
FIG. 3 is a partially transparent perspective view of the "Rocking switch".

Said "MM System" consist of a called "Rocking Switch" (1), i.e. a kind of Normally Closed (NC) switch connected through electrical wires from a side with a called "light source" (2), i.e. a generic source of light, and from the other side with a called "battery source" (3), i.e. a power source consisting of one or more batteries, which in turn are connected (FIG. 1).

Said "MM System" can be placed into any container that uses a traditional zipper system.

Said "Rocking Switch" (1) is composed of a called "casing" (4), i.e. a box of non-conductive material, containing in a side a called "magnet" (5), i.e. a magnet fixed inside of the said "casing" (4) precisely glued in the lower part of it between two identical pieces called "division support" (12), i.e. two pieces of non-conductive material, a called "plate" (6) i.e. a plate of conductive material that is connected in its lower part with an "electric wire" (7) that comes outside the "casing" (4) through a called "hole a" (13), i.e. a hole on a side of the said "casing", and a called "switch operating portion" (8), i.e. a plate of conductive material that is connected in its lower part with another "electric wire" (7) that comes outside the "casing" (4) through a called "hole b" (14), i.e. another hole in the box on the side opposite where the said "hole a" (13) is located.

Said "casing" (4) has also a called "slot" (20), i.e. an elongated slit on its upper side.

One pole of the said "magnet" (5) is in stable contact with the said "plate" (6), while the other pole of the same is in openable contact with the said "switch operating portion" (8).

Said "switch operating portion" (8) is positioned to be under the influence of the said "magnet" (5) and free to swing on a called "pin" (9), i.e. an imaginary line passing through the segment specified by the intersection between the lower end of said "switch operating portion" (8) and the said "casing" (4), but always remaining under the influence of the said "magnet" (5).

The contact between the said "magnet" (5) and the said "switch operating portion" (8) close the said "Rocking Switch" (1) and the said "MM system".

This contact is only allowed in the middle part of the said "switch operating portion" (8) where its shape becomes curved (FIGS. 1/2/3).

The contact between the said "switch operating portion" and the said "magnet" is never allowed in the lower part due to one of the said "division support" (12) which acts as a separator between them in the bottom part of the said "casing" (4) (FIGS. 1/3).

Said "Rocking Switch" (1) is a Normally Closed (NC) Switch, it means that in its rest position electricity can flow, but when said "switch operating portion" (8) is moved away from said "magnet" (5) the circuit is opened and the electricity stops flowing.

More specifically, said "Rocking Switch" (1) is a switch that stays automatically in ON mode due to the magnetic force caused by the presence of said "magnet" (5) and switches to OFF mode due to the effect of a mechanical force which opposes the first, applying on an element of the same said "Rocking switch" (1).

Said "plate" (6) is connected through an "electric wire" (7) that comes out of the said "casing" (4) with said "light source" (2) and in turn with one pole of said "battery source" (3).

Said "switch operating portion" (8) is connected through another "electric wire" (7) that comes out of said "casing" (4) to the other pole of said "battery source" (3).

Said "switch operating portion" (8) is naturally attracted by magnetic force from the said "magnet" (5), closing the "Rocking Switch" (1) and the "MM system".

Figure 4:
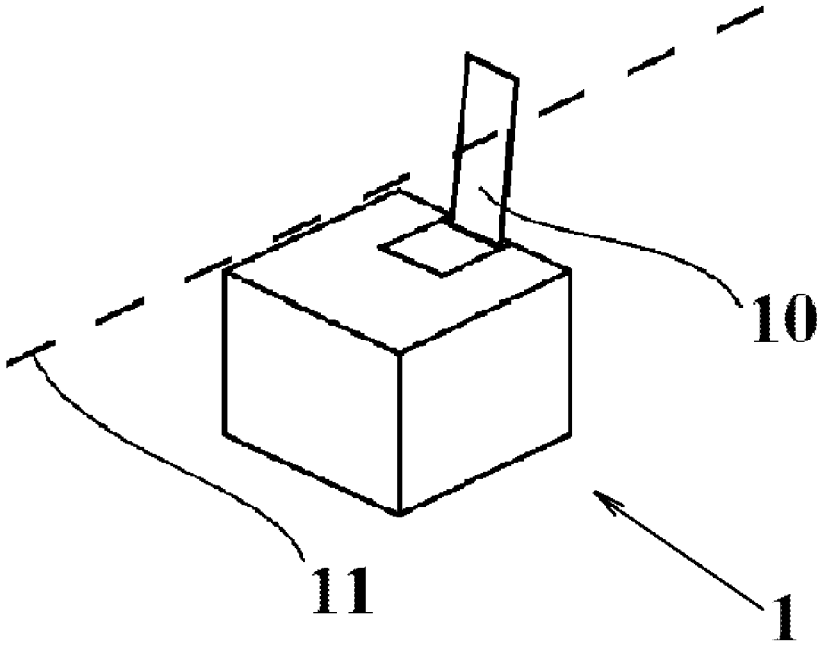
FIG. 4 is a perspective view to visually identify the "working line".

Said "switch operating portion" (8) has a called "extension" (10), i.e. a part of it that comes out from the upper part of said "casing" (4) through the said "slot" (20), crossing the called "working line" (11) (FIG. 4) i.e. an imaginary line on which it is possible to interact with the said "extension" (10).

By applying a mechanical force on the said "extension" (10) in the direction of the said "working line" (11) such as to overcome the magnetic force exerted by the said "magnet" (5) on the said "switch operating portion" (8) the effect is that the said "switch operating portion" (8) begins to move away from the said "magnet" (5) disconnecting from it, open the said "Rocking Switch" (1) and interrupting the said "MM System".

When the mechanical force ceases to act on the said "extension" (10) or even only when the mechanical force becomes less than the magnetic force the said "switch operating portion" (8) starts moving towards the said "magnet" (5) due to the effect of the magnetic force until the two touch and the said "Rocking Switch" (1) closes, closing the said "MM system" as well.

The purpose of the said "MM system" is that the electric circuit is initially closed by a magnetic force and becomes open by a mechanical force acting on the said "extension" (10).

The said "extension" (10) can also have different shapes and elongations, according to the needs of the overall work system, without changing its main function which is to allow the opening of the "Rocking Switch" (1) using a mechanical force.

The aforementioned "battery source" (3) includes a box containing some disposable or rechargeable batteries connected to each other or a single rechargeable battery meaning a type of electrical battery that can be charged, discharged into an external load, and recharged many times, as opposed to a disposable or primary battery, which is supplied fully charged and discarded after use.

Figure 5:
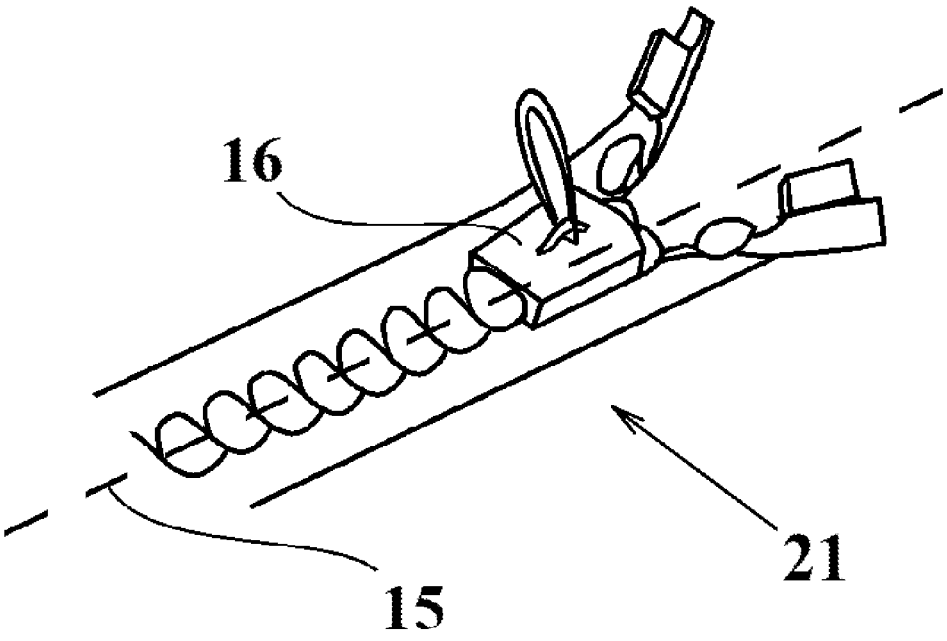
FIG. 5 is a perspective view to visually identify the "zipper line".
Figure 6:
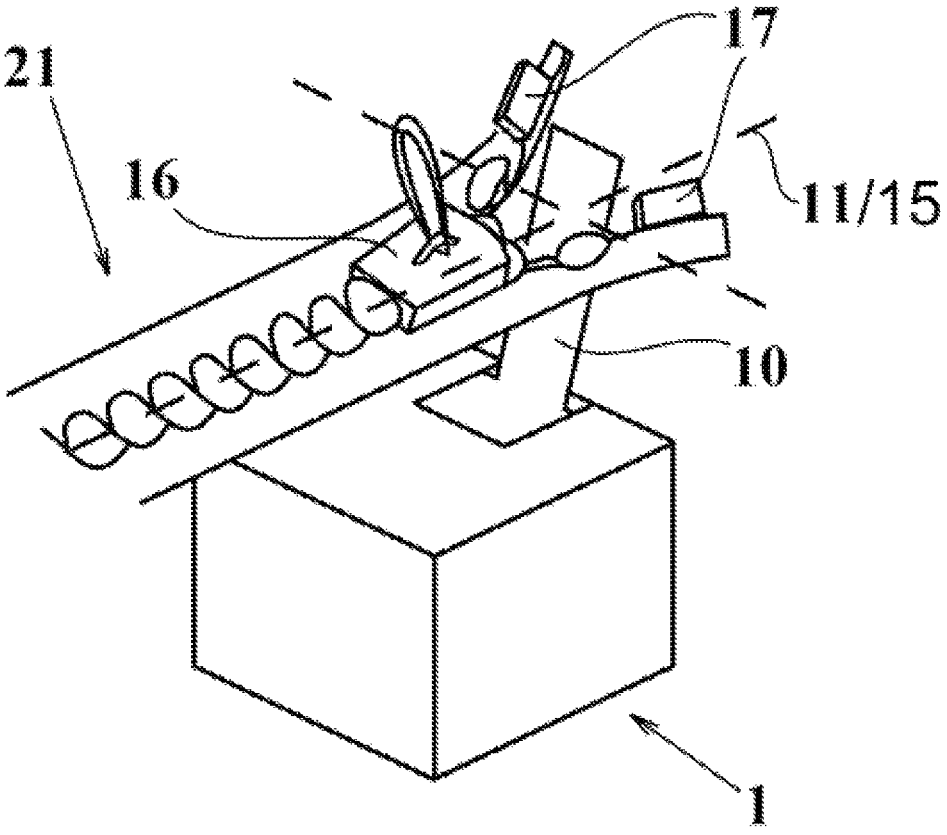
FIG. 6 is a perspective view to locate the correct placement of the "extension" just before the "last closing hook" of the zipper, and on the overlapping of the "working line" and the "zipper line".

For example, but not limited to it, placing the said "MM system" inside a container that uses a zipper system we must consider the following parameters: The called "zipper line" (15) i.e. an imaginary line that overlaps the field of action defined by the movement of the moving part of the zipper called "slider" (16) in the final part of the "zipper" (21) (FIG. 5) must overlap the said "working line" (11), in the way the said "extension" (10) crosses the said "zipper line" (15) near the zipper final part, so that the called "slider" (16) can act by exerting a mechanical force on the "extension" (10), correlating the opening and closing of the zipper to the closing and opening of the "MM system" (FIG. 6).

Said "extension" (10) allows the said "slider" (16) to move all the said "switch operating portion" (8) mechanically, as soon as the said "slider" (16) comes to touch the said "extension" (10), starting move the said "switch operating portion" (8) away from the said "magnet" (5) disconnecting the said "switch operating portion" (8) from the said "magnet" (5) breaking the contact created by the magnetic force and opening the "MM system".

Forced by the said "slider" (16), the said "switch operating portion" (8) remains stationary away from the said "magnet" (5), as long as the zipper remains closed, this start to happen when the zipper is almost completely closed.

Opening the zipper, the said "slider" (16) begins to slide on the said "zipper line" (15) allowing the said "switch operating portion" (8) to move towards the said "magnet" (5) that attracts it.

Said "switch operating portion" (8) begins to approach the said "magnet" (5) up to the point of contact and closing again the "MM System".

Then opening the "zipper" (21) creates the effect of closing the said "MM system", this starts to happen when the zipper starts to open.

Summarizing it all, when the zipper is starting to open, due to a magnetic force present between the said "magnet" (5) and the said "switch operating portion" (8), the said "MM system" closed and the said "light source" (2) is turned ON.

When the zipper is almost totally closed by mechanical force exerted by the said "slider" (16) on the said "extension" (10), contrasting the magnetic force acting on the said "switch operating portion" (8), the "MM System" becomes open and the said "light source" (2) becomes turned OFF.

Placing the said "MM system" inside a container that uses a classic zipper system is easy.

The positioning of the said "MM system" depends above all on the type of container in which it is placed.

Generally, the said "Rocking Switch" (1) will be positioned at the end of the traditional zipper, i.e. where the said "slider" (16) comes to completely close the container.

The said "Rocking Switch" (1) can be glued directly under a side of the final part of the traditional zipper, so that the said "zipper line" (15) overlaps the said "working line" (11).

In this placement, the said "extension" (10) will be positioned just before the called "last closing hook" (17) i.e. the last hook closure of the traditional zipper, in such a way as to guarantee the effect of the opening of the "MM system" just before the traditional zipper has been completely closed (FIG. 6).

Figure 7:
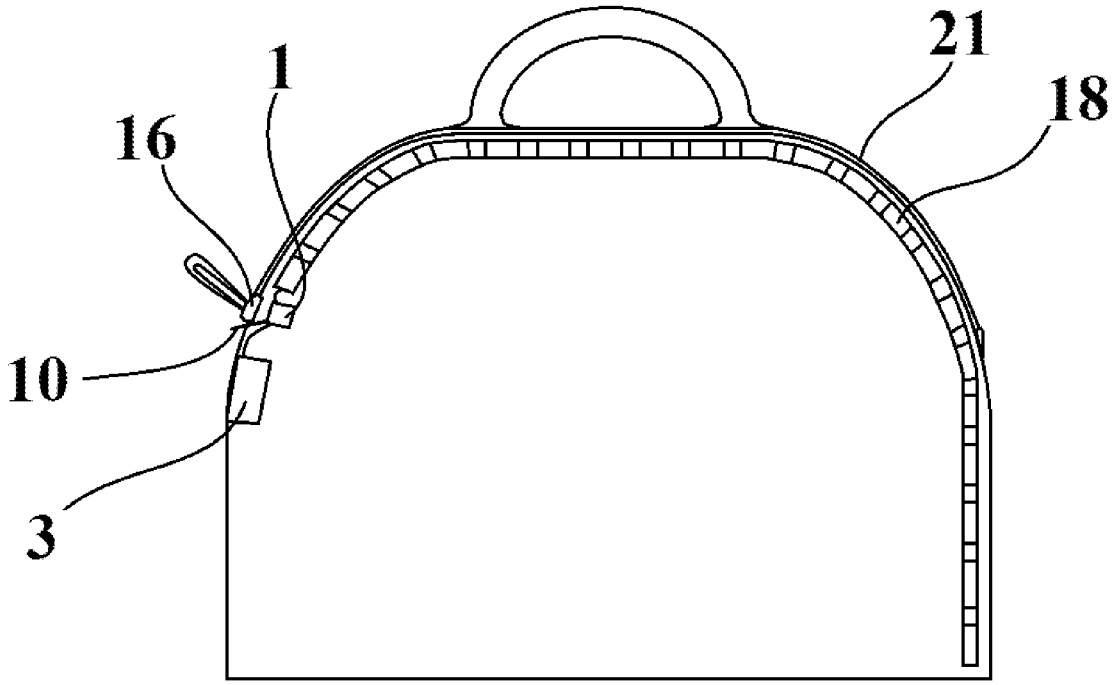
FIG. 7 is a sectional side view of an example of the "MM System" placed in a handbag.
Figure 8:
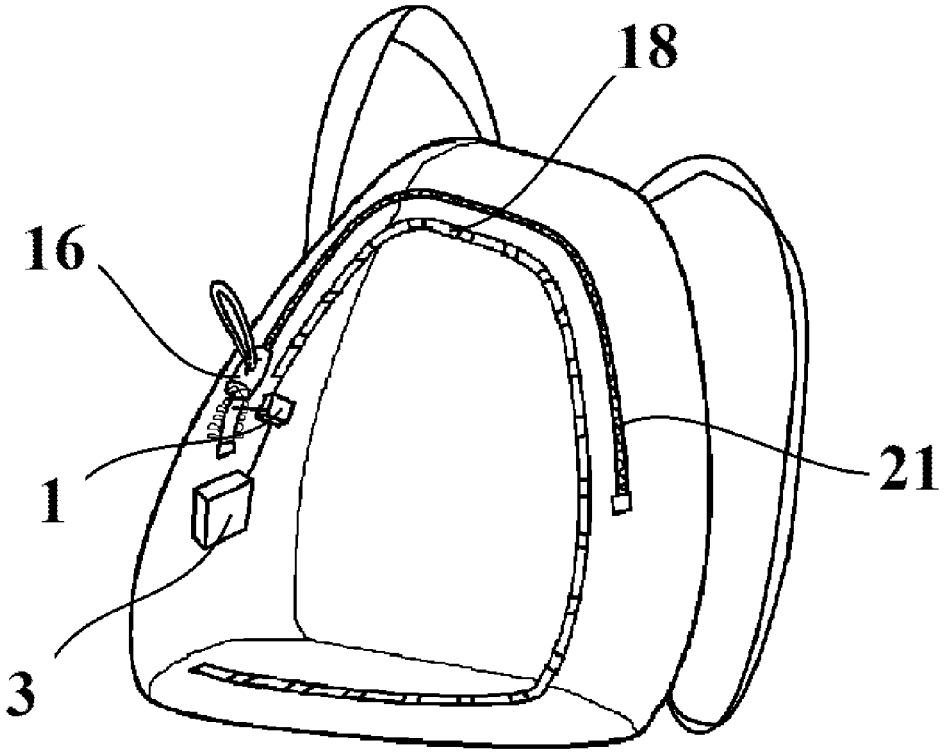
FIG. 8 is a perspective view of an example of the "MM System" placed in a backpack.

In this kind of embodiment, said "light source" (2) can be a called "LED tape" (18), i.e. a flat-flexible circuit board occupied by surface mounted light-emitting diodes (SMD LEDs) and other components including an adhesive backing that can be glued inside the container at the user's convenience (FIGS. 7/8).

Said "LED tape" (18) can be provided in different shape and number of LEDs present in the device according to the container model.

Said "LED tape" (18) can be also cut at will according to the necessary length.

Figure 9:
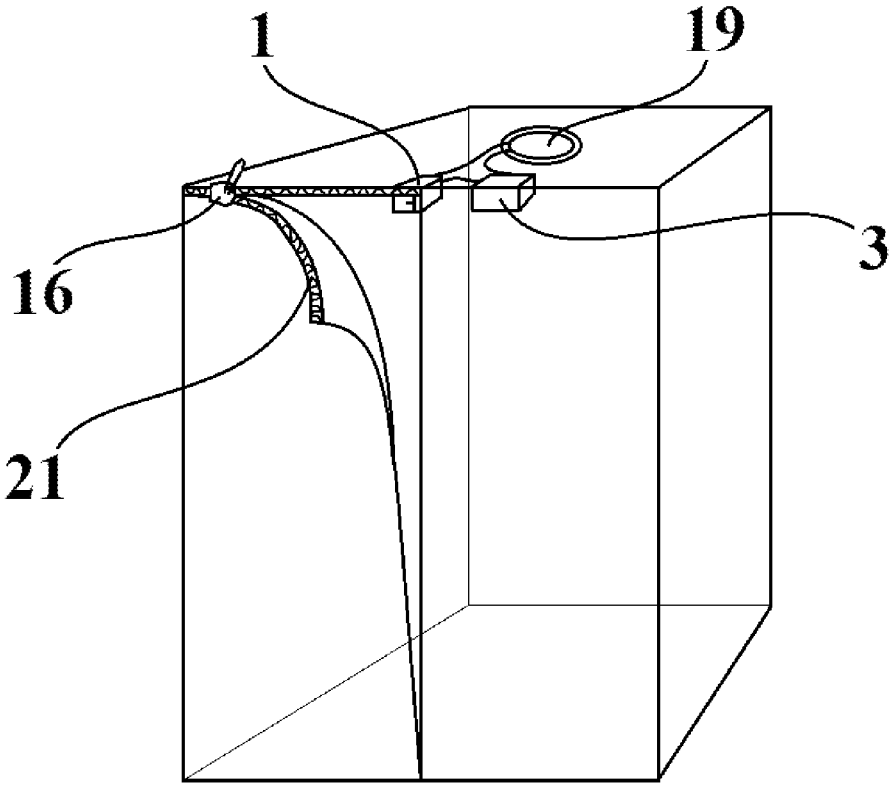
FIG. 9 is a perspective view of an example of the "MM System" placed in a storage closet.

Said "light source" (2) can also be a called "small LED light" (19), i.e. a single rigid plastic box including of a few LEDs and an adhesive backing (FIG. 9).

The said "battery source" (3) will be positioned in such a way as to be easily accessible for battery replacement, preferably in the upper part of the container, and fixed with an adhesive backing.

More elegantly, said "MM system" can also be positioned inside the container in such a way as to ensure greater stability, for example including special supports for the battery made in various types of fabric to be sewn into the lining of the container and a kind of compartments in transparent plastic material in which to slide the said "LED tape" (18) sewn into the lining of the container.

The present invention said "MM system" and the said "Rocking Switch", as described and illustrated in all details, can be modified in different variations included in the scope of the inventive concept.

Furthermore, all the components of the said "MM system" can be substituted by other technically equivalent elements.

SEQUENCE LISTENING

Not applicable

The invention claimed is:

1. An electrical switch comprising: a casing; a magnet located inside the casing; a switch operating portion provided in the casing, and configured to move between a first position where the switch operating portion is not in contact with the magnet and a second position where the switch operating portion is in contact with the magnet; and at least one division support made of non-conductive material, said division support provided between a lower part of both the magnet and the switch operating portion, wherein the division support never allows the lower part of the magnet to contact the lower portion of the switch operating portion.

2. The electrical switch, as claimed in claim 1, the switch operating portion is further configured to move into the first position by a physical force applied therefrom, and into the second position by a magnet force from the magnet.

3. The electrical switch, as claimed in claim 2, further comprising an extension portion coupled to switch operating portion, the extension portion configure to receive the physical force and cause the switch operating portion to move into the first position, the extension portion can be of different shapes and sizes.

4. The device claimed in the claim 3, wherein the physical force is produced by a movement of an object.

5. A device, including the electrical switch as claimed in the claim 3, and an electrical circuit comprising a battery source and a light source, wherein when the switch operating portion is in the first position the electrical switch is open, and when the switch operating portion is in the second position the electrical switch is closed causing the battery source to power the light source.

6. A container with at least two sections all equipped with zipper systems and at least two devices as claimed in claim 5 embedded in it, wherein each zipper system includes a zipper slider, each zipper system configured to open and close one of the container's section, each electrical switch is positioned near the end of the related zipper system to allow the related zipper slider to contact the related extension portion to actuate the related switch operating portion into the first position when closing the related zipper system, and allowing the related magnetic force to actuate the related switch operating portion into the second position when the related zipper starts to open up, to open and close the related switch and turn the light source of the related section ON/OFF.

7. A device as claimed in claim 5, further comprising: a container; and a zipper system including a zipper slider, the zipper system configured to open and close the container; wherein the electrical switch is positioned near the end of the zipper system to allow the zipper slider to contact the extension portion to actuate the switch operating portion into the first position when closing the zipper system, and allowing the magnetic force to actuate the switch operating portion into second position when the zipper starts to open up, to open and close the switch and turn the light source ON/OFF.

8. The device claimed in the claim 7, wherein the light source is a single LED light source.

9. The device claimed in the claim 7, wherein the light source is a multicolor LED light source.

10. The device as claimed in the claim 7, wherein the battery source contains a plurality of disposable batteries connected to each other.

11. The device claimed in the claim 7, wherein the battery source contains a plurality of rechargeable batteries, connected to each other.

12. The device claimed in the claim 7, wherein the battery source contains a single rechargeable battery.

13. The device claimed in the claim 7, wherein the container has at least one handle.

14. The device claimed in the claim 7, wherein the container is provided with wheels in the lower part.

15. A device as claimed in claim 7, wherein the container has at least two sections.

16. The device claimed in the claim 7, wherein the container is made of different materials.

17. The device claimed in the claim 7, wherein the container includes at least one of planar or curved side surfaces.

18. The device as claimed in the claim 7, wherein the light source is a plurality of LED lights sources.

19. The device claimed in the claim 18, wherein the container is provided with a compartment in transparent plastic material in which to slide the LED tape.

20. The device claimed in the claim 18, wherein the container is provided with a special support for the battery made in various types of fabric.

* * * * *